US006691633B1

(12) United States Patent
Metzger et al.

(10) Patent No.: US 6,691,633 B1
(45) Date of Patent: Feb. 17, 2004

(54) PONTOON PADDLE BOAT

(75) Inventors: Andrew T. Metzger, Belle Plaine, KS (US); Shin Tsai Wu, Taipei (TW)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 10/224,550

(22) Filed: Aug. 20, 2002

(51) Int. Cl.[7] ..... B63B 1/00

(52) U.S. Cl. ..... 114/61.1; 114/162; 440/26; 440/27

(58) Field of Search ..... 114/61.1, 162; 440/26, 27, 29, 31, 32

(56) References Cited

U.S. PATENT DOCUMENTS

| | | | | | |
|---|---|---|---|---|---|
| 1,084,798 | A | | 1/1914 | Granquist | |
| 1,691,396 | A | | 11/1928 | Lindstrom | |
| 2,066,101 | A | * | 12/1936 | Dunlap et al. | 114/61.1 |
| 2,332,009 | A | | 10/1943 | Perri | |
| 3,410,244 | A | | 11/1968 | Graham | |
| 3,608,112 | A | | 9/1971 | Irgens | |
| 3,999,501 | A | | 12/1976 | Duarte | |
| 4,140,076 | A | * | 2/1979 | Borglum | 114/283 |
| 4,231,309 | A | * | 11/1980 | Pelletier | 114/162 |
| 4,372,241 | A | * | 2/1983 | Tritt | 114/162 |
| 4,496,325 | A | | 1/1985 | Tweg | |
| 4,500,297 | A | * | 2/1985 | Boulva | 440/27 |
| 4,782,777 | A | | 11/1988 | Sussman | |
| 4,796,555 | A | | 1/1989 | Chang | |
| 4,998,498 | A | | 3/1991 | Gallichan | |
| 5,413,066 | A | | 5/1995 | Spencer, Jr. et al. | |
| 5,651,706 | A | | 7/1997 | Kasper | |
| 5,732,650 | A | | 3/1998 | Peterson | |
| 5,989,081 | A | * | 11/1999 | Lekhtman | 440/27 |
| 6,083,062 | A | | 7/2000 | Treloar et al. | |
| 6,173,671 | B1 | | 1/2001 | Casull | |
| 6,311,632 | B1 | | 11/2001 | Noel, Jr. | |
| 6,343,560 | B1 | | 2/2002 | Myers | |

* cited by examiner

*Primary Examiner*—Stephen Avila
(74) *Attorney, Agent, or Firm*—Leydig, Voit & Mayer, Ltd

(57) ABSTRACT

A collapsible pontoon paddle boat that includes inflatable pontoons that may be deflated, and a series of frame pieces that may be disassembled. The frame structure includes metal tubes that snap into anchors that are integrally formed on the sides of the pontoons. A removable seat is provided for the boat that is supported by a series of cinch straps that allows fore and aft sections of the seating surface to be adjusted up and down relative to the pontoons. A plurality of mounting locations may be provided for removable cranks and paddle wheels so that their position may be adjusted relative to the seat. A rudder for the pontoon paddle boat is connected to the frame for the pontoon paddle boat by a friction connection and includes a pivot mechanism that permits folding to a position where it extends parallel to the boat.

23 Claims, 7 Drawing Sheets

PONTOON PADDLE BOAT

TECHNICAL FIELD OF THE INVENTION

The present invention generally relates to small watercrafts, and more specifically to a pontoon boat having paddle wheels.

BACKGROUND OF THE INVENTION

Small boats are popular for a number of reasons. First, they may provide entertainment in the form of activities such as fishing and recreational boating. In addition, the small boats may provide an alternate form of exercise. Small boats are convenient in that they usually can be removed from the water after use, and can typically be lifted by one or two people and carried to a storage location.

One downside to small boats is that they often require a large storage space when not in use. To provide adequate support for people, the boats are typically long and wide. In addition, because the holes and other components of the boat must be seaworthy, they are typically heavy and cumbersome. Therefore, transport of small boats is often difficult, and many times requires a pickup truck or a trailer of some sort.

SUMMARY OF THE INVENTION

The present invention provides a collapsible pontoon paddle boat. The pontoon paddle boat includes inflatable pontoons that may be deflated and a series of frame pieces that may be disassembled and stored with the deflated pontoons in a compact configuration. The broken-down pontoon may be conveniently stored or transported, for example in a carrying bag.

In accordance with one aspect of the present invention, the frame structure includes metal tubes that snap into anchors that are integrally formed in the sides of the pontoons. The anchors or the tubes may include snap connectors that allow quick disassembly of the frame from the pontoons.

In accordance with another aspect of the present invention, a seat is provided for the pontoon paddle boat that is removable and collapsible. The seat is supported by a series of cinch straps that allows fore and aft sections of the seating surface to be adjusted up and down relative to the pontoons. In addition, the entire seating surface may be lowered or raised using the cinch straps. The seat also includes a back that is attached by straps. The straps may be adjusted so as to provide a comfortable seating posture for a user.

In accordance with another aspect of the present invention, the paddle wheels and cranks for the paddle wheels are connected to front anchors on the pontoons. The paddle wheels may disconnect from the cranks to provide compact storage of the paddle wheels. Also, if desired, a plurality of mounting locations may be provided for the cranks and paddle wheels so that their position may be adjusted relative to the seat. In this manner, the cranks may be situated so that they conveniently fit against the feet of a user seated on the seat, regardless of the size of the user.

In accordance with another aspect of the present invention, a rudder for the pontoon paddle boat is connected to the frame for the pontoon paddle boat by a friction connection. The friction in the connection may be overcome, for example, when the rudder contacts the ground or other objects located underneath the boat. In this manner, the rudder is not damaged in shallow water.

The rudder also includes a pivot mechanism that allows the rudder to be folded to a position where it extends parallel to the pontoon paddle boat. The storage position allows the pontoon paddle boat to be pulled up on shore, without dragging the rudder into the ground.

The pontoon paddle boat of the present invention provides many benefits over prior art small boats. It may be folded into a compact configuration, and may be adjusted so as to fit a variety of different sized users. Other features may be employed to make the pontoon paddle boat more comfortable. For example, cup holders may be formed integrally into the frame, and a cargo net may also be provided.

Other advantages will become apparent from the following detailed description when taken in conjunction with the drawings, in which:

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well-known features may be omitted or simplified in order not to obscure the present invention.

Figure 1:
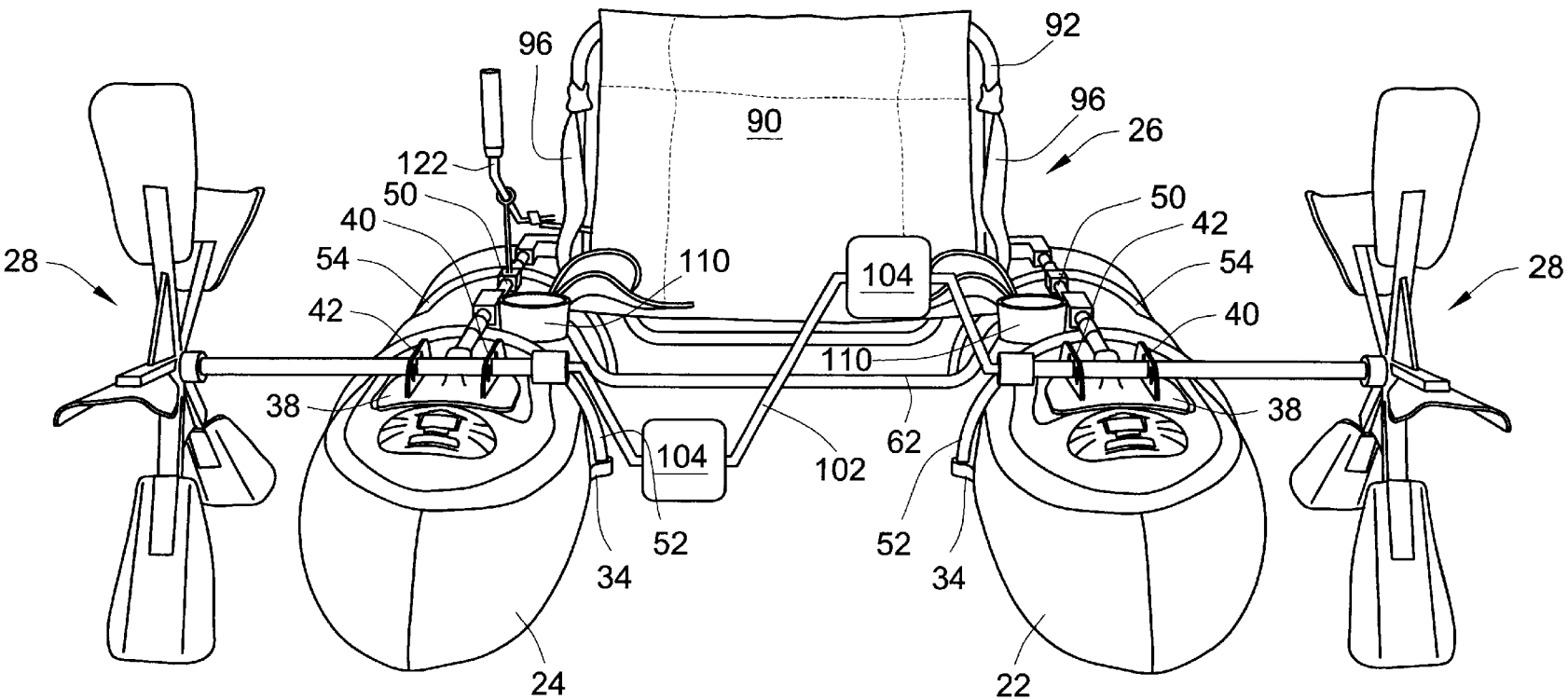
FIG. 1 is a front, perspective view of a pontoon paddle boat embodying the present invention.

Referring now to the drawings, in which like reference numerals represent like parts throughout the several views, FIG. 1 shows a pontoon paddle boat 20 incorporating the present invention. Briefly described, the pontoon paddle boat 20 includes left and right pontoons 22, 24. A seat 26 is mounted between the pontoons 22, 24 at an upper surface of the pontoons. Paddle wheels 28 are mounted on the front of the pontoon paddle boat 20. The paddle wheels 28 may be rotated by user's leg using cranks 102, as described further below.

Figure 7:
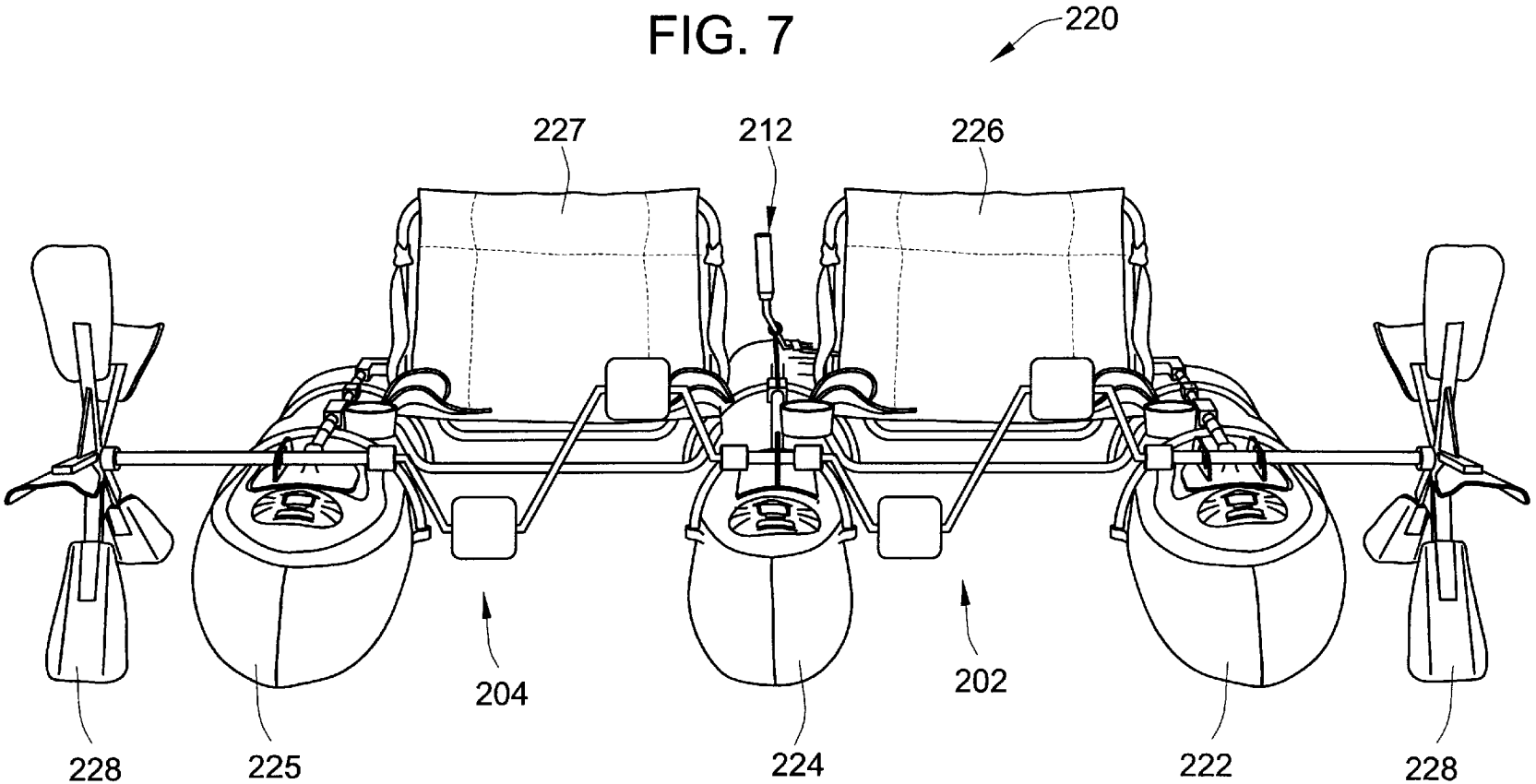
FIG. 7 is a front perspective view of a pontoon paddle boat having two seats in accordance with an alternate embodiment of the present invention.

Although shown as having two pontoons 22, 24, an alternate embodiment of the pontoon paddle boat 220, shown in FIG. 7, may be designed using the concepts of the present invention and having more than two pontoons. For example, the example shown in FIG. 7 includes three pontoons 222, 224, and 225, and two seats 226, 227, with a crank 202, 204 for each rider to drive the paddle wheels 228.

In accordance with one aspect of the present invention, the pontoons 22, 24 are inflatable. If desired, each of the pontoons 22, 24 may include a separate air chamber inside the pontoon so that puncturing of the outside of one pontoon does not result in the pontoon paddle boat 20 rolling over or flipping.

The pontoons 22, 24 are preferably tapered along their length so that they are larger in diameter at their rear portions. In this manner, the pontoons 22, 24 may support the weight of a rider leaning back in the pontoon paddle boat 20 without the rider's weight causing the front end of the boat to rise too much out of the water. Otherwise, the paddle wheels 28 may not make adequate contact with the water.

In accordance with another aspect of the present invention, as further described below, the pontoon paddle boat 20 includes a number of metal frame members that may be attached to the pontoons 22, 24. The metal frame members provide support and structure for the pontoon paddle boat 20, and may be detached for storage of the pontoon paddle boat.

Figure 2:
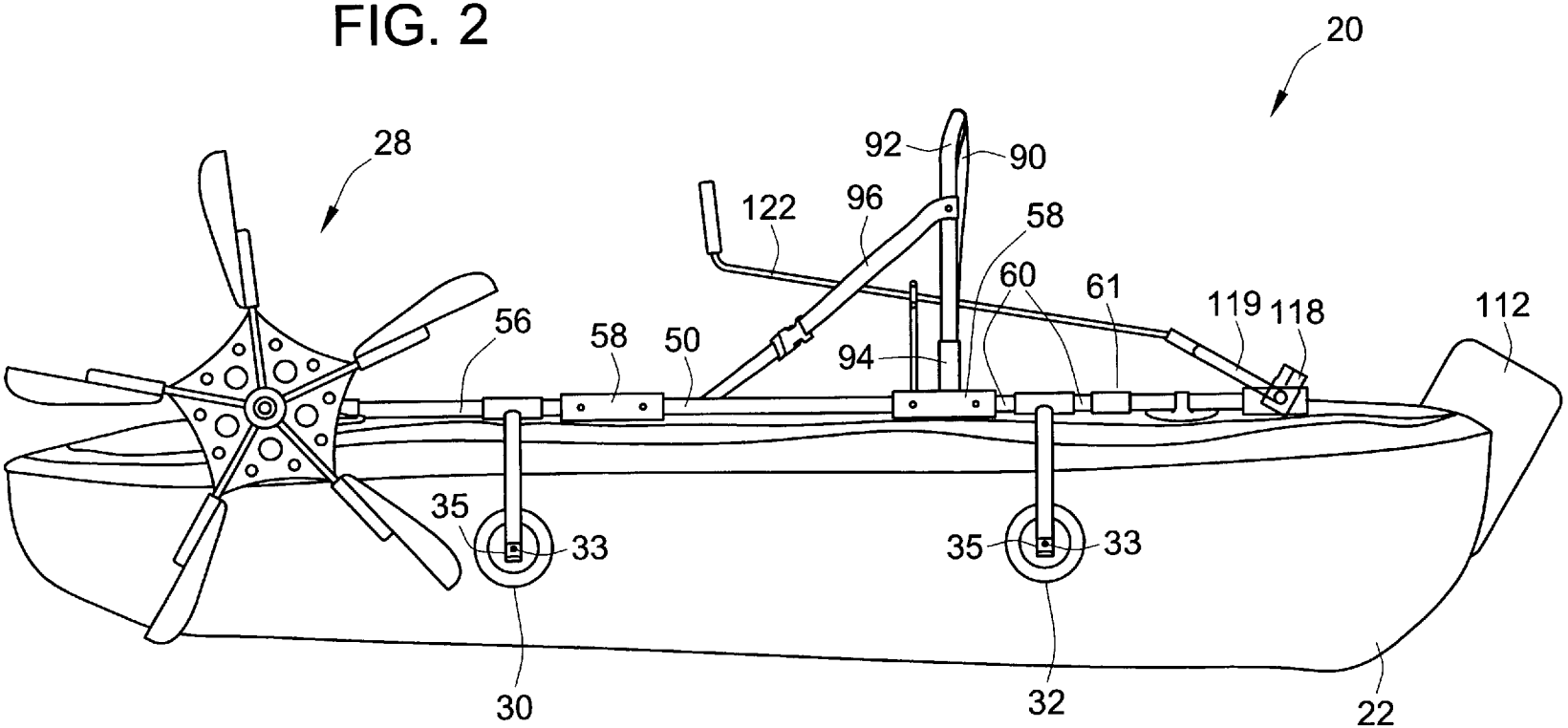
FIG. 2 is a side view of the pontoon paddle boat of FIG. 1.

To aid in attachment of the metal frame members, each of the pontoons 22, 24 includes front and rear outside anchors 30, 32 (FIG. 2). The pontoons 22, 24 also include front and rear inside anchors 34, 36. The front and rear inside and outside anchors 30–36 preferably are all permanently affixed to the outside walls of the pontoons 22, 24, such as by sewing or by an adhesive. Each of the front and rear inside and outside anchors 30, 32, 34, 36 includes upwardly facing cylinders 33 having snap connectors 35 (best shown in FIG. 5), the function of which is described in detail below.

Figure 5:
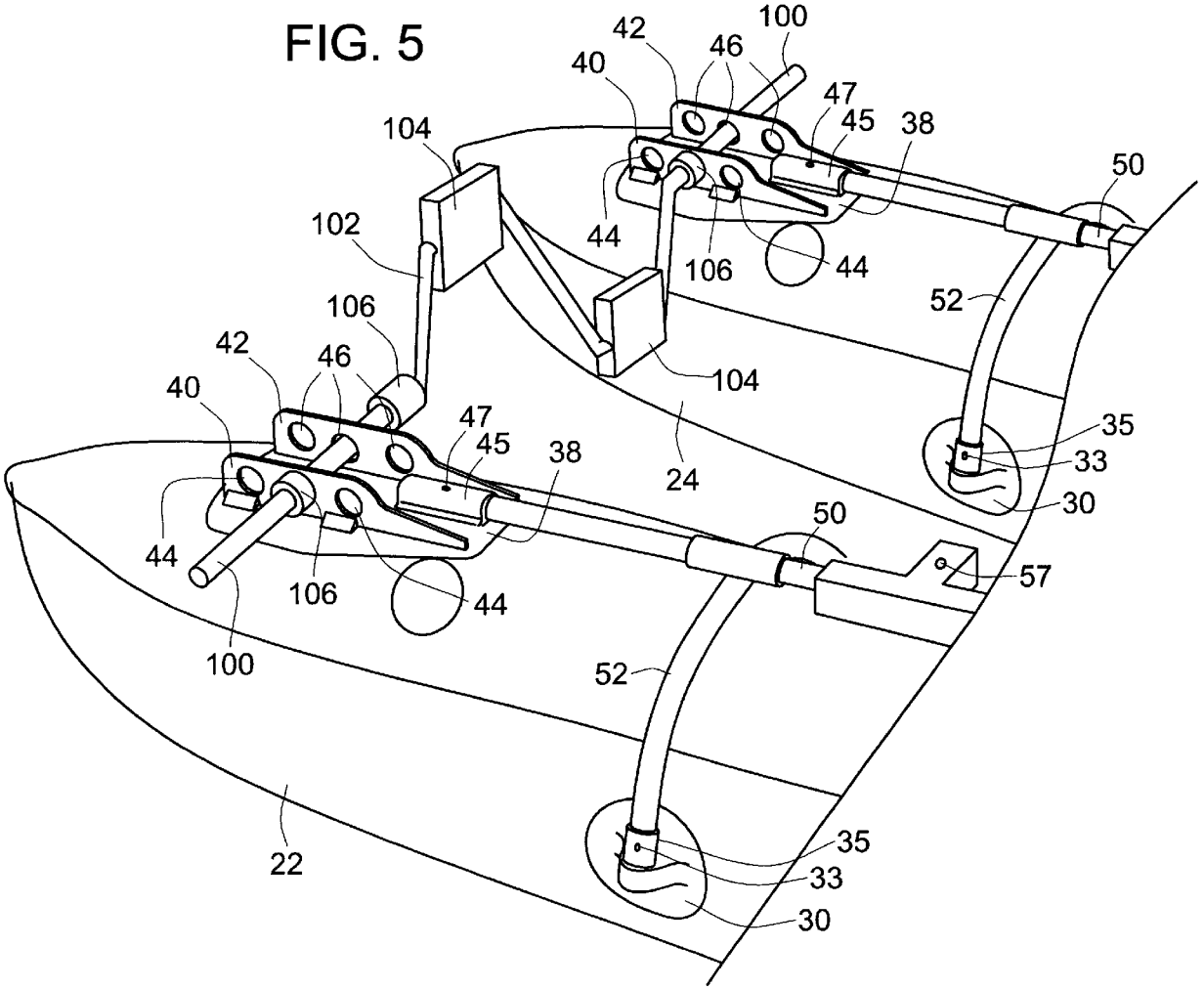
FIG. 5 is a cutaway perspective view of a front portion of the pontoon paddle boat of FIG. 1, with paddle wheels removed for detail.

In addition, as can best be seen in FIG. 5, each of the pontoons 22, 24 includes a top, front anchor 38. The top, front anchors 38 include a pair of upwardly extending plates 40, 42 having a series of holes 44, 46 extending therethrough. Rearwardly extending cylinders 45 having snap connectors 47 are located on the back portion of the top, front anchors 36. Eyelets 48 are also attached to the rear of the pontoons 22, 24. The top, front anchor 38 and the rear eyelets 48 may also be attached by adhesive, sewing, or in other suitable manners.

Figure 3:
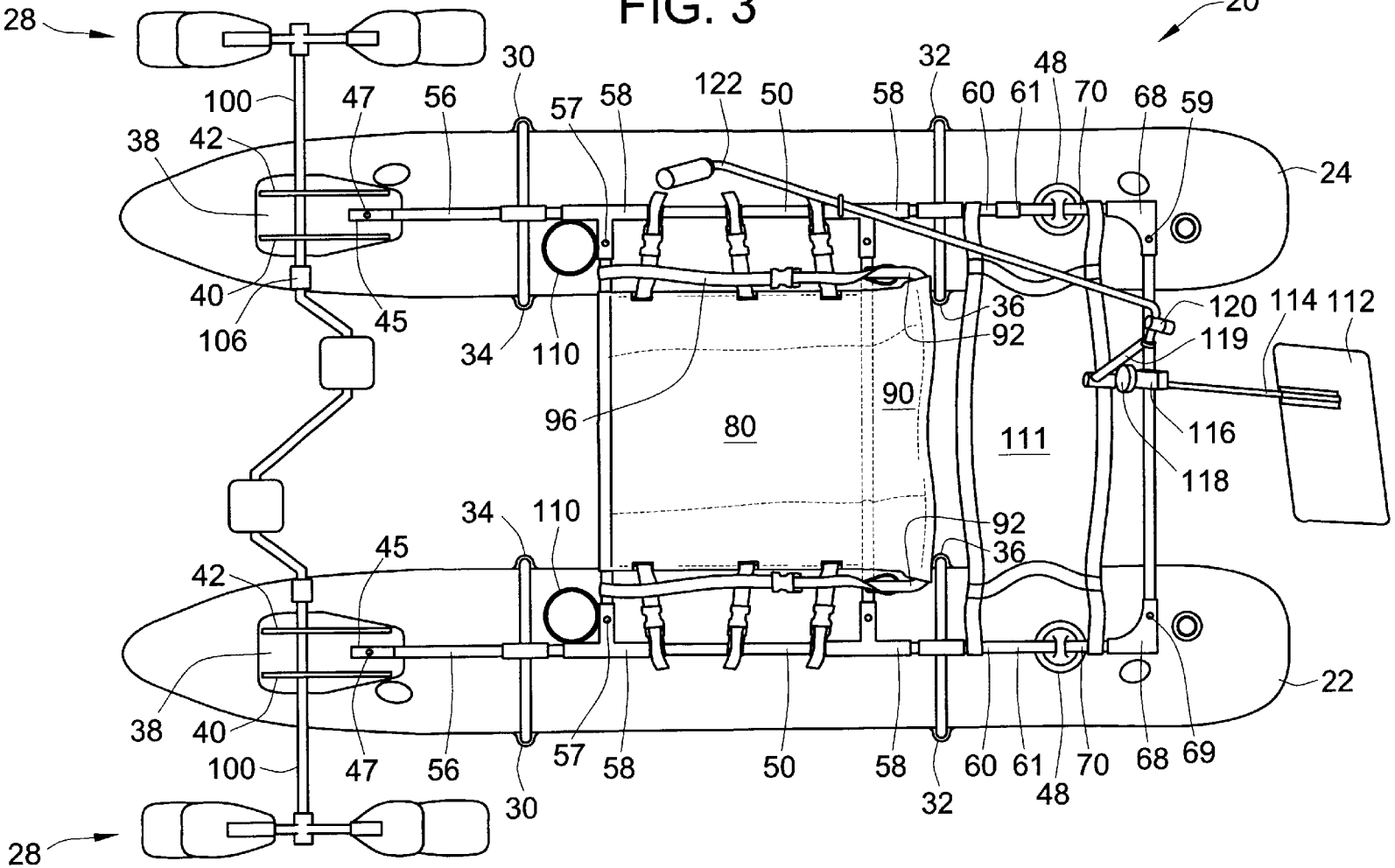
FIG. 3 is a top view of the pontoon paddle boat of FIG. 1.

As can best be seen in FIG. 3, the frame structure includes a pontoon frame piece 50 aligned along the top of each of the pontoons 22, 24. The pontoon frame piece 50 includes an elongate central element and front and rear U-shaped elements 52, 54 extending perpendicularly downward from the central frame piece. A front extension 56 extends forward from the central frame piece and into the rearwardly extending cylinder 45 on the top, front anchor 38. A pair of T-attachments 58 is located at the front and rear portions of the pontoon frame piece 50 adjacent to the front and rear portions of the seat 26. The leg of the T-attachments includes a snap connector 57. A short rear extension 60 extends rearwardly from the pontoon frame piece 50, and also includes a snap connector 61.

Pontoon frame piece 50 is attached to one of the pontoons 22, 24 by snapping the ends of the front and rear U-shaped elements 52, 54 into the upwardly extending cylinders 33 on the front and rear inside and outside anchors 30–36. The snap connectors 35 hold these pieces together, and may be, for example, spring clips that snap into holes on the respective U-shaped elements 52, 54. In addition, the forward end of the front extension 56 is inserted into rearwardly extending cylinder 45 and snapped into place in a similar manner by the snap connector 47. These five connections of the front pontoon frame piece 50 to the respective pontoon 22 or 24 provide a stable base for the pontoon frame piece 50 to the pontoon.

The spring clips or connectors described are known in the tube connection art, and their operation and structure are simplified in order to not obscure the present invention. Other connection mechanisms may be used so that frame pieces may be easily attached and disconnected from the pontoons 22, 24. For example, the frame pieces may include spring clips that snap into the anchors on the pontoons 22, 24.

A front crossbar 62 (FIG. 1) extends between the front T attachments 58 of the opposite pontoon frame pieces 58 of the opposite pontoon frame pieces 50, and is similarly snapped into place on the snap connectors 57. The front cross bar 62 extends downward along the sloped surface of the pontoon 22 or 24 and then across to the opposite pontoon. In this manner, the front crossbar 62 is U-shaped, and is out of the way of the seat 26. A similar bar, such as a rear metal cross bar 64 (FIG. 4) extends between the rear T-attachments 58 on the two pontoon frame pieces 50, and may also be snapped into the snap connections 57.

A rear crossbar 66 (FIG. 3) extends along the back of the pontoon. The rear crossbar 66 includes a pair of L-attachments 68 at its ends. The L-attachments 68 may include snap connectors 69. Two forward extensions 70 extend out of the L-attachments 68. When installed on the pontoon paddle boat 20, the forward extension 70 extends through the rear top eyelets 48 and into snap connector 61 on the short rear extensions 60 of the pontoon frame pieces 50. The rear crossbar 66 may be disconnected from the L-attachments 68 for disassembly, if desired. The rear crossbar 66 and the forward extensions 70 form a U-shaped rear frame for the pontoon paddle boat 20.

The pontoon frame pieces 50, the front crossbar 62, the metal crossbar 64, and the rear cross bar 66 are preferably formed of metal, such as tubular steel, and provide a stable, rigid frame for the pontoon paddle boat 20. The rear crossbar 60 and its connection to the pontoon frame pieces 50 provide a rigid rear frame for the pontoon paddle boat 20, and prevent the rear of the boat from rotating upward when a user is in the seat 26. In addition, because of the snap connectors 61, the snap connectors 47 on the top, front anchor 38, and the snap connectors 35 on the front and rear inside and outside anchors 30–36, each of these frame pieces may be easily removed and taken apart so that the frame members may be stored in a compact configuration.

The pontoon boat 220 may similarly be attached to frame members that may break down in separate parts, such as is shown in FIG. 7. Each of the pontoons 222, 224, and 226 may include similar anchors for attaching the frame members. Alternatively, the center pontoon 224 or one or more of the outer pontoons 222, 225 may be additionally or alternatively be attached by straps that attach to anchors on the sides of the pontoons 222, 224, and 226. The straps may add additionally stability for the extra weight that must be carried by a two-seater pontoon boat. The handle 212 for the rudder (not shown in FIG. 7, but similar to the rudder 112) may extend between the two seats 226, 227.

Figure 6:
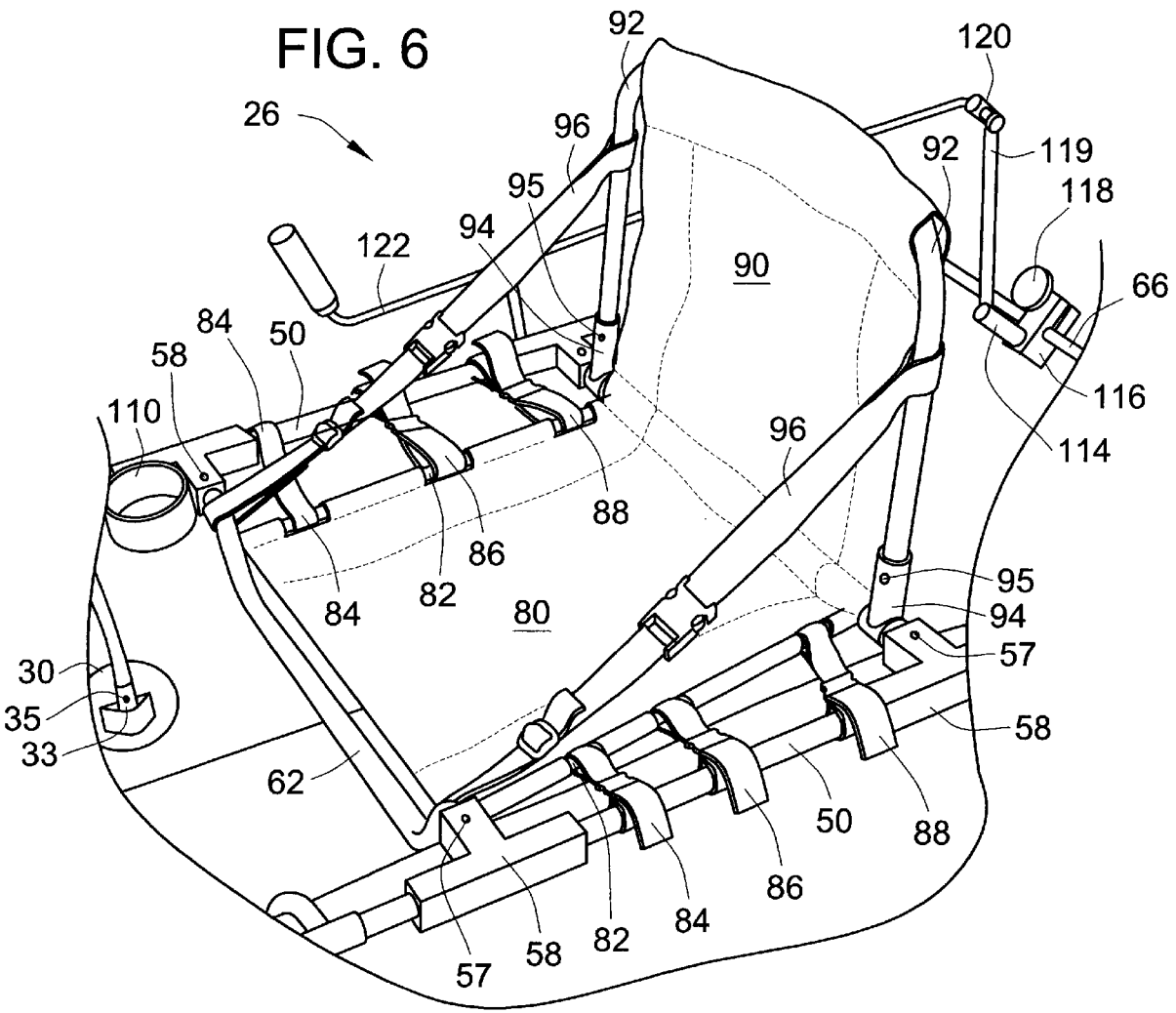
FIG. 6 is a perspective view of a seat for the pontoon paddle boat of FIG. 1.

Turning now to FIG. 6, the seat 26 includes a lower seating surface 80. The U-shape of the front and rear cross bars permits the lower seating surface to be lowered below a top line of the pontoons 22, 24. This feature provides more stability for a user of the pontoon paddle boat 20. The lower seating surface 80 includes a pair of parallel bars 82 that are stitched into side edges of the lower seating surface. A plurality of cinch straps 82, 84, 86 extend between the pontoon frame piece 50 and the bars 82 for each respective pontoon 22 and 24. In the embodiment shown, three cinch straps 84, 86, 88 are used. The cinch straps 84, 86, 88 are spaced along the bars 82 so that they are located at the front, middle, and rear of the bars. The cinch straps 84, 86, 88 each include a cinching mechanism, such as a webbing end buckle, that permits the cinch strap to be tightened or loosened, and allows the cinch strap to be locked into position.

In use, a user may selectively cinch any of the straps 84, 86, 88 so as to raise a selective portion of the lower seating surface 80 relative to other portions of the seating surface. For example, the front cinch straps 84 may be tightened, and the rear cinch straps loosened, to raise a front of the lower seating surface 80 relative to a rear of the lower seating surface. In addition, all of the cinch straps 84, 86, 88 may be cinched so as to raise the entire lower seating surface 80. Likewise, each of the cinch straps 84, 86, 88 may be loosened so as to lower the seating surface 80. This feature allows the lower seating surface 80 to be arranged so that it is comfortable for a user. The U-shaped of the front and rear cross bars permits the lower seating surface to be lowered below a top line of the pontoons 22, 24. This feature provides more stability for a user of the pontoon paddle boat 20.

The seat 26 also includes a back 90. The back 90 includes a U-shaped post 92 that extends upward from pivoting supports 94 that are attached to the ends of the metal crossbars 64. The pivoting supports 94 are pivotally attached to metal crossbar 64 so that the U-shaped post 92 may rotate or pivot relative to the metal cross bar 64 and the pontoon paddle boat 20. Each of the pivoting supports 94 may include a snap connector 95 for releasing and attaching the seat back 90. A pair of cinch straps 96 extends between the front crossbar 62 and upper portions of the U-shaped post 92. The cinch straps 96 may be tightened or loosened to adjust the angle of the back 90 relative to the lower seating surface 80. Buckles 98 may be provided on the cinch straps 96 for detaching the cinch straps from the front cross bar 62 when disassembling the pontoon paddle boat 20.

The front portion of the pontoon paddle boat 20 can best be seen in FIG. 5. The paddle wheels 28 are removed to show detail. The paddle wheels 28 are attached to ends of rods 100. The rods 100 thread into the paddle wheels 28 and form part of the shaft for the paddle wheel 28 and crank assembly of the pontoon paddle boat. The threads on the rods 100 are preferably aligned so that they tighten as a user rotates the paddle wheels 28. If desired, the paddles wheels 28 may be attached to the rods 100 in another suitable manner, such as by snap connectors.

Opposite ends of rods 100 are attached to the cranks 102. The cranks 102 include rotatably-mounted pedals 104 for a user to pedal the paddle wheels 28. The cranks 102 include threaded collars 106 for fitting onto threaded ends of the rods 100. Again, if desired, other attachment mechanisms may be used, such as snap connectors. If threaded, the threads are preferably aligned so that they tighten as a user rotates the paddle wheels 28.

The rods 100 may be released from the cranks 102 by rotating the threaded collars 106. The rods 100 may then be released from the holes 44, 46 in the top, front anchor 38. The rods 100 may be reinserted in different holes 44, 46 in the top, front anchor 38 so as to adjust the length of the cranks 102 from the seat 26. In this manner, the pontoon paddle boat 20 may be adjusted so that it may comfortably fit the length of the legs of a user.

The rods 100 may be released from the paddle wheels 28 and the cranks 102 so that each of these pieces may be stored separately. This feature aids in compactly storing the pontoon paddle boat 20.

In accordance with another aspect of the present invention, one or more cup holders 110 may be provided on the pontoon paddle boat 20. In the embodiment shown, the cup holders 110 are formed integrally on the inside front edges of the front T-attachments 58 of the pontoon frame piece 50. The cup holders 110 provide a location for a user to place a cup or other items while operating the pontoon paddle boat 20. The cup holders 110 may be placed in other locations, but are convenient as shown because they are easily accessible by a user. As an example, FIGS. 1 and 3 show the use of two cup holders 110, and FIG. 6 shows only one.

A cargo net 111 may be provided across the back of the pontoon paddle boat. The cargo net 111 may extend between opposite bars on the pontoons 22, 24, and may be used to hold various items while a user is paddling the pontoon paddle boat 20.

Figure 4:
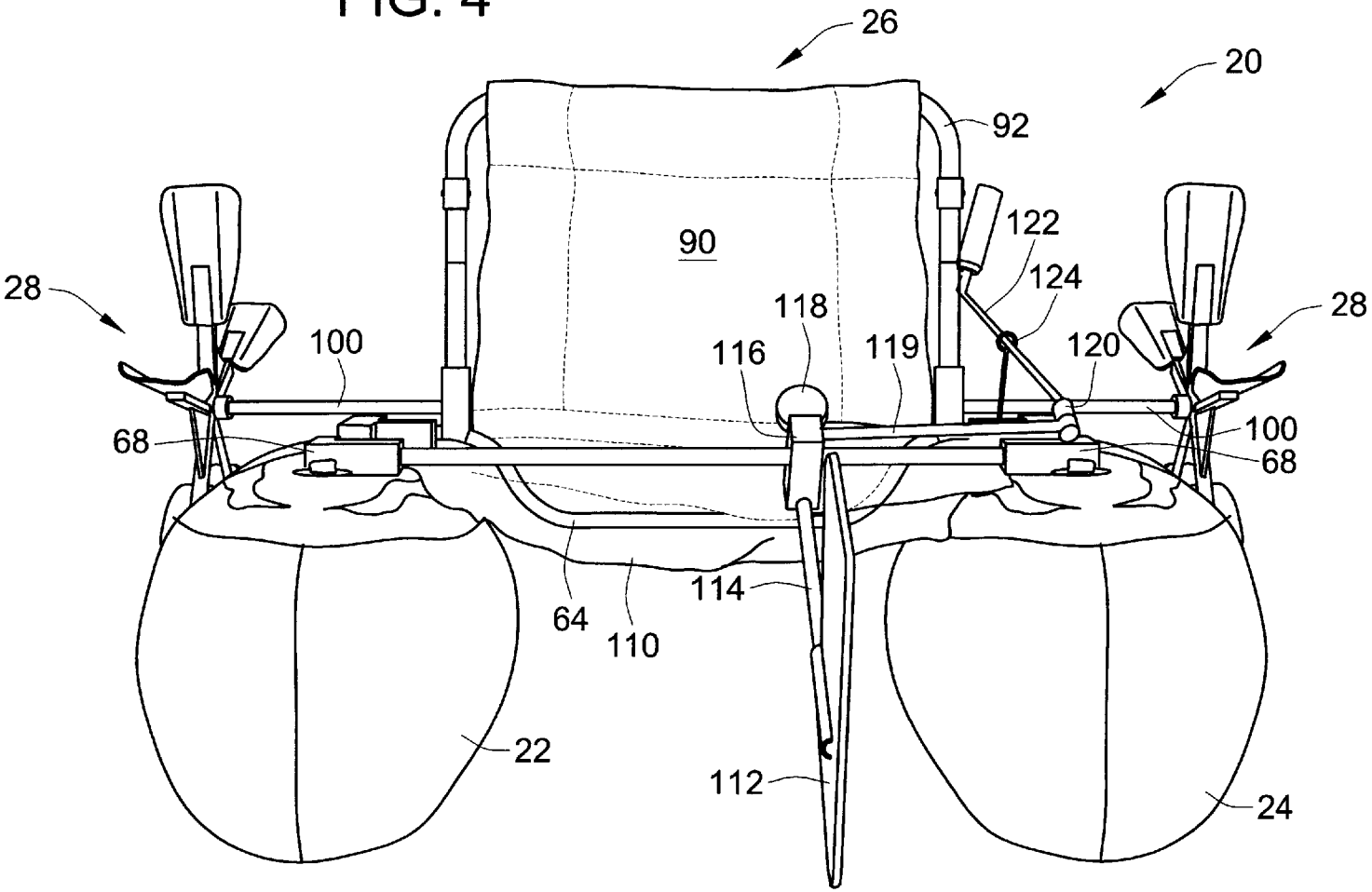
FIG. 4 is a rear view of the pontoon paddle boat of FIG. 1.

A rudder assembly for the pontoon paddle boat 20 can be seen in FIGS. 3 and 4. The rudder assembly includes a rudder 112 extending perpendicularly outward from a shaft 114. The shaft 114 is rotatably connected to a clamp 116 that is mounted on the rear crossbar 66. The clamp 116 includes a knob 118 that may be threaded and may be used to tighten or loosen a split opening of the clamp 116 onto the rear crossbar 66. Preferably, tightening the knob 118 onto the rear crossbar 66 does not create a rigid locking connection between the clamp 116 and the rear crossbar 66, but instead creates a friction grip onto the rear crossbar. In this manner, if the rudder 112 and/or the shaft 114 come into contact with an obstruction while the rudder is downward, the clamp 118 may have its friction grip overcome and the rudder and shaft are free to rotate about the rear crossbar 66. This feature prevents damage to the rudder 112.

An extension arm 119 extends perpendicularly and horizontally outward from the top of the shaft 114. A swivel attachment 120 extends upward from the extension arm 119 and includes a hole therethrough. A bent end of a handle 122 extends through the hole, and may be attached, for example, by placing a nut or other fastener on the end of the bent portion of the handle 122. The handle 122 extends forward from the swivel attachment 120 through an eyelet 124 (FIG. 4) mounted adjacent to the seat 126.

The swivel attachment 120 permits the handle to be pulled forward, with the swivel attachment rotating, the extension arm 119 being pulled forward, and the rudder rotating to cause a right turn. The handle 122 may similarly be moved rearward to cause the rudder to rotate back in the opposite direction, promoting a left turn. In both of these movements, the handle does not rotate within the swivel attachment, but instead the swivel attachment rotates relative to the extension arm 119.

The rotatable attachment of the handle 122 to the swivel attachment 120 permits the rudder 112 and the shaft 114 to be folded upward for storage of the pontoon paddle boat 20. To this end, a user may rotate the knob 117 to release the clamp 116, and may pull forward on the top part of the shaft 114 to bend the rudder 112 upward. In this motion, the extension arm 118 rocks forward, and the bent end of the handle 122 rotates within the swivel attachment 120. As such, the handle 122 remains attached to the swivel attachment 120 when the rudder 112 is in the lowered or storage positions.

The pontoon paddle boat 20 of the present invention provides many advantages over prior art boats. The pontoon paddle boat includes inflatable pontoons 20, 22 that may be deflated, and a series of frame pieces that may be disassembled and stored with the deflated pontoons in a compact configuration. The broken-down pontoon may be conveniently stored or transported, for example in a carrying bag.

The frame structure includes metal tubes that snap into anchors that are integrally formed in the sides of the pontoons. The snap connectors allow quick disassembly of the frame from the pontoons. The seat 26 allows fore and aft sections of the seating surface to be adjusted up and down relative to the pontoons 22, 24. The cranks 102 and paddle wheels 28 may be mounted in different location so that their position may be adjusted relative to the seat 26. The friction connection of the rudder 112 to the frame permits the rudder to fold upward when it encounters an obstacle. The pivoting connection of the rudder 112 to the handle 122 allows the rudder to be folded to a position where it extends parallel to the pontoon paddle boat 20.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. A pontoon boat comprising:

first and second inflatable pontoons, each of the first and second pontoons comprising:
front and rear outer side anchors;
front and rear inner side anchors;
a top rear anchor; and
a top front anchor;

a first frame member that includes two U-shaped elements extending outward therefrom, the first frame member being configured so that the U-shaped elements are removably attachable to the front and rear outer and inner anchors of the first pontoon;

a second frame member that includes two U-shaped elements extending outward therefrom, the second frame member being configured so that the U-shaped elements are removably attachable to the front and rear outer and inner anchors of the second pontoon;

a first forward extension extending from the first frame member and removably connectable to the top front anchor of the first pontoon;

a second forward extension extending from the second frame member and removably connectable to the top front anchor of the second pontoon;

a rear U-shaped frame member, removable attachable to the first and second frame members and the rear anchors of the first and second pontoons;

a front frame member removably attachable between the first and the second frame members; and a paddle wheel and crank assembly removably attachable to the front anchors on the first and second pontoons.

2. The pontoon boat of claim 1, wherein each of the rear anchors comprises an eyelet through which the rear U-shaped frame extends.

3. The pontoon boat of claim 1, wherein each of the front anchors comprises a hole through which a shaft for the paddle wheel and the crank assembly may be extended.

4. The pontoon boat of claim 2, wherein each of the front anchors comprises a plurality of holes through which the shaft may be extended, the plurality of holes providing different mounting locations for the paddle wheel and crank assembly.

5. The pontoon boat of claim 1, wherein each of the front anchors comprises a rearwardly extending cylinder for receiving the respective forward extension.

6. The pontoon boat of claim 1, further comprising a seat mounted between the first and second frame members.

7. The pontoon boat of claim 6, wherein the seat comprises a seating surface, the seating surface being mounted below a top line of the pontoons.

8. The pontoon boat of claim 7, wherein the front frame member extends below the seating surface.

9. The pontoon boat of claim 1, further comprising a third pontoon mounted between the first and second pontoons.

10. The pontoon boat of claim 1, further comprising a cup holder mounted on the first frame member.

11. The pontoon boat of claim 10, wherein the cup holder is mounted at a juncture of the front frame member and the first frame member.

12. The pontoon boat of claim 1, further comprising a cup holder mounted adjacent to one of the pontoons.

13. The pontoon boat of claim 12, further comprising a plurality of cup holders.

14. A pontoon boat, comprising:

first, second, and third pontoons;

a first seat mounted between the first and second pontoons;

a second seat mounted between the second and third pontoons; and a crank and paddle wheel assembly comprising:
at least one paddle wheel;
a first set of cranks for use by a user sitting in the first seat; and
a second set of cranks for use by a user sitting in the second seat.

15. The pontoon boat of claim 14, further comprising detachable frame members that connect the first, second, and third pontoons.

16. A boat, comprising:

a first elongate fire member, a second elongate frame member extending parallel to the first elongate frame member;

a seat, comprising:
a flexible seating surface;
a first rod connected to the flexible seating surface and extending along one edge of the flexible seating surface; and a second rod connected to the flexible seating surface and extending along an opposite edge of the flexible seating surface;

a first plurality of cinch straps attached between the first frame member and the first rod, the cinch straps being spaced along the first frame member and the first rod; and
a second plurality of cinch straps attached between the second frame member and the second rod, the cinch straps being spaced along the second frame member and the second rod.

17. The boat of claim 16, further comprising a first pontoon attached to the first frame member, and a second pontoon attached to the second frame member, the scat extending between the first pontoon and the second pontoon.

18. The pontoon boat of claim 17, wherein the cinching straps may be loosened so as to lower the seating surface below a top line of the pontoons.

19. The boat of claim 16, wherein the seat further comprises a seat back, pivotally mounted adjacent a back edge of the flexible seating surface, and a strap extending from the seat back to a position on the boat.

20. The boat of claim 19, wherein the strap is a cinch strap.

21. The boat of claim 16, wherein the number in the first and second pluralities is three.

22. A boat, comprising:

a rod mounted horizontally in the boat;

a clamp connected to the rod;

a shaft extending downward from the clamp;

a rudder connected to the shaft below the clamp;

wherein the clamp includes a friction connection on the shaft that is sufficient to hold the rudder in water during normal use, but the friction is overcome and the clamp rotates around the shaft when the rudder or shaft come into contact with an obstacle;

an extension extending upward from the clamp;

an arm attached at one end of the extension and extending outward perpendicular to the extension;

a swivel connection attached to the other end of the arm and extending perpendicular to the arm; and a handle rotatably attached to the swivel connection.

23. A boat, comprising:

a rod mounted horizontally in the boat;

a clamp connected to the rod, the clamp comprising a split opening and a knob for tightening the split opening around the rod;

a shaft extending downward from the clamp;

a rudder connected to the shaft below the clamp;

wherein the clamp includes a friction connection on the shaft that is sufficient to bold the rudder in water during normal use, but the friction is overcome and the clamp rotates around the shaft when the rudder or shaft come into contact with an obstacle.

* * * * *